United States Patent [19]

Herzog

[11] 4,153,153

[45] May 8, 1979

[54] PRE-GUMMED TEA BAG TAG ASSEMBLY

[76] Inventor: Michael Herzog, 158 Lynn Ave., Hampton Bays, L.I., N.Y. 11946

[21] Appl. No.: 888,163

[22] Filed: Mar. 20, 1978

[51] Int. Cl.[2] ..... B65D 85/70; A23F 1/08

[52] U.S. Cl. ..... 206/0.5; 426/83

[58] Field of Search ..... 206/0.5; 426/80–84

[56] References Cited

U.S. PATENT DOCUMENTS

| | | | |
|---|---|---|---|
| 2,793,954 | 5/1957 | Nelson et al. | 426/83 |
| 3,092,242 | 6/1963 | Irmscher | 206/0.5 |
| 3,387,978 | 6/1968 | Major | 206/0.5 X |

FOREIGN PATENT DOCUMENTS

| | | | |
|---|---|---|---|
| 2204139 | 8/1973 | Fed. Rep. of Germany | 206/0.5 |

*Primary Examiner*—Davis T. Moorhead

*Attorney, Agent, or Firm*—George Spector

[57] ABSTRACT

A tea bag used for brewing a cup of tea in a cup; the tea bag being attached by a string to a tag that is gummed on one side so to be easily attachable to an outer side of the tea cup and thus prevent the need of fishing out the bag from a brewed tea water afterwards; and means in a modified design of the invention whereby the tag additionally serves as a tea bag squeezer.

3 Claims, 5 Drawing Figures

Fig. 1
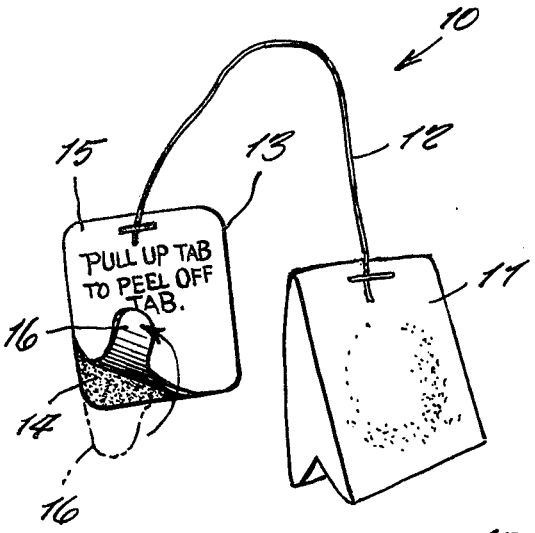
Fig. 2
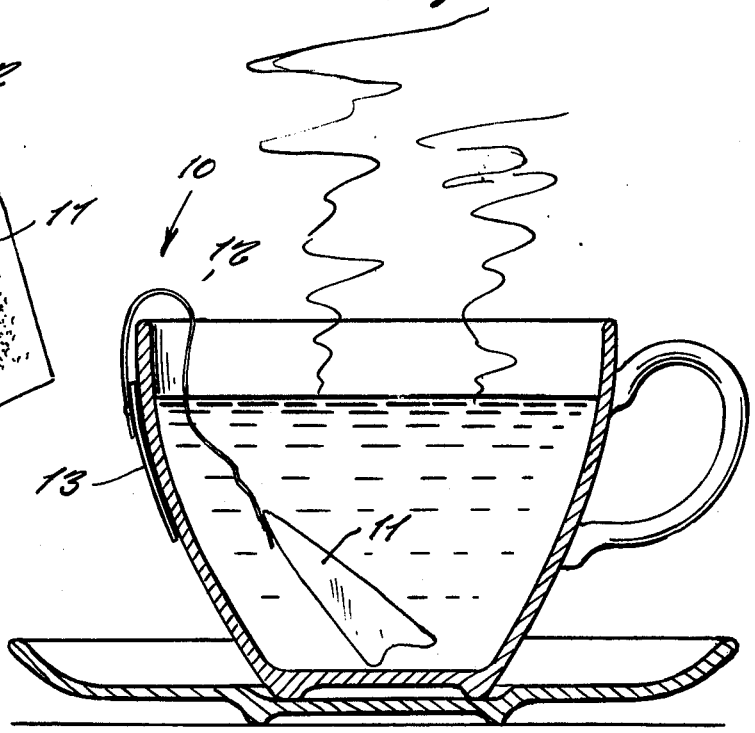
Fig. 3
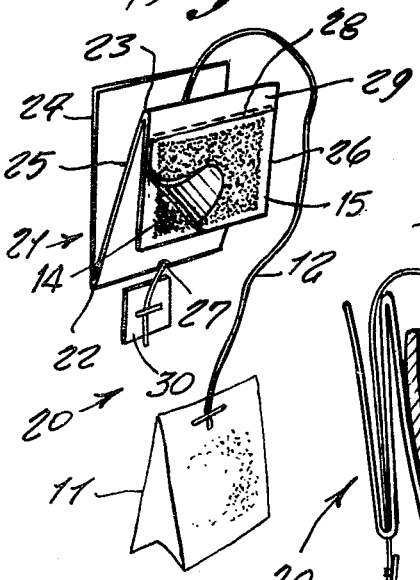
Fig. 4
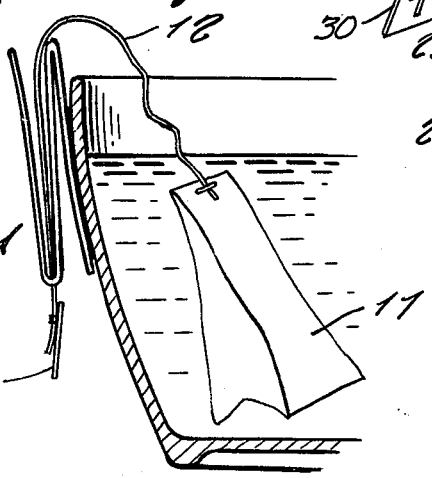
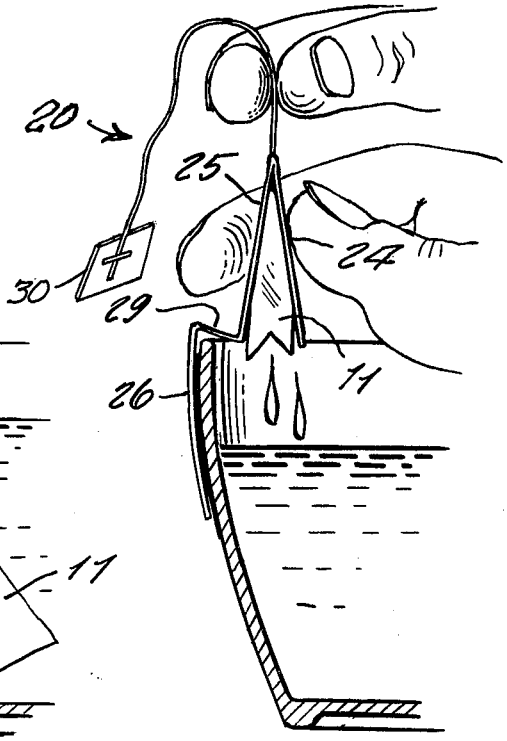
Fig. 5

PRE-GUMMED TEA BAG TAG ASSEMBLY

This invention relates generally to tea bags.

A principal object of the present invention is to provide a tea bag attached by a string to a tag that can be stuck against the outside of the cup, so that the tea bag can be easily pulled out of the water after brewing and not fall into cup during pouring.

Another object is to provide a tea bag tag which on one side has space of advertising so to help make sales.

Still another object is to provide a tea bag and tag assembly which in a modified design thereof includes a tea bag squeezer so to extract all the flavor from the tea leaves.

Other objects are to provide a tea bag which is simple in design, inexpensive to manufacture, rugged in construction, easy to use and efficient in operation.

These and other objects will be readily evident upon a study of the following specifications and the accompanying drawings wherein:

FIG. 1 is a perspective view showing one design of the invention.

FIG. 2 is a side cross sectional view of a tea cup showing the present invention attached thereto.

FIG. 3 is a perspective view of another design of the invention.

FIG. 4 is a view similar to FIG. 2 and showing the invention of FIG. 3 attached thereto.

FIG. 5 shows the invention of FIG. 3 being used to prepare a second or third cup of tea by squeezing the tea bag so to extract all remaining drops of flavor therefrom; and which is accomplished by the gummed tea tag assembly being made with a folded over flap into which the bag can be pulled by the tea bag string, so that the bag can then be conveniently squeezed, as shown in FIG. 5.

Referring now to the drawing in detail and more particularly to FIGS. 1 and 2 thereof at this time, the reference numeral 10 represents a tea bag assembly according to the present invention wherein there is an individual tea bag 11 attached to one end of a string 12; the tea bag consisting of a porous paper bag containing some tea leaves. The opposite end of the string is attached to a flat tag 13 made of heavy paper or of flexible plastic and which on one side has space for an advertisement, while an opposite side is coated with pressure sensistive adhesive 14 for adhering to the cup. A coated paper 15 having a convenient extending lug 16 for being pulled by the fingers, covers the adhesive paper prior to use for retaining freshness thereof.

In use, the bag is dropped into hot water 16 placed in a cup while the tag 13 is adhered to the cup, as shown in FIG. 2. After the water is brewed, the string 12 and tag 13 are thus readily pulled to lift the bag out of the water.

In FIGS. 3, 4 and 5, a modified design of the tea bag assembly 20 includes the tea bag 11 and string 12 as above described, but the tag 13 is replaced by a tag assembly 21 made of a long strip of thick paper or plastic which has two transverse folds 22 and 23 so to form panels 24, 25 and 26 which are folded zig zag adjacent to each other. The string extends through a hole 27 along a lower fold 22 and is stapled to a tag 30. The endmost panel 26 has the adhesive 14 on its outer side covered by the paper 15. The adhesive is confined to a lower portion of the panel so that an additional fold line 28 thereabove forms a relatively narrow band 29 between folds 23 and 28, for purposes as shown in FIG. 5. The tag 21 is mounted on the cup so that the band 29 projects higher than the cups upper edge as shown in FIG. 4, so that in operative use, the band can be folded to rest across the top edge of the cup in order that the panels 24 and 25 are over the cup interior. Thus when the tea bag is placed between the panels 24 and 25, and squeezed therebetween, the water drops therefrom fall directly inside the cup, as shown in FIG. 3, so that all the tea flavor is thus extracted therefrom. Thus when it is desired to squeeze the bag, the user pulls the end tag 30 causing the string 12 to pull the bag 11 between the panels 24 and 25 as seen in FIg. 5

While various changes may be made in the detail construction, it is understood that such changes will be within the spirit and scope of the present invention as in defined by the appended Claims.

What is claimed is:

1. A tea bag tag assembly comprising in combination a tea bag attached to one end of a string and a tag attached to an opposite end of said string, said tag including one side thereof coated with a pressure sensitive adhesive covered by a removable protective cover paper for attachment to an outer side of a tea cup, including means for receiving, squeezing and positioning said bag over said cup with the tag attached to the cup to cause fluid from the bag to flow into said cup when squeezed.

2. An assembly as in claim 1, whereas said means comprise opposing walls forming a pocket to receive said bag, said walls being pivotally secured to each other and pivotally secured to the adhesive portion of said bag.

3. An assembly as in claim 2, wherein the string is slidably mounted through the lowermost portion of the said walls and the uppermost portion of the pocket is above the said adhesive portion when mounted on the cup.

* * * * *